US005673633A

United States Patent [19]

Pfister

[11] Patent Number: 5,673,633

[45] Date of Patent: Oct. 7, 1997

[54] TABLE LEG SYSTEM

[76] Inventor: Joel W. Pfister, 4967 Kensington Gate, Shorewood, Minn. 55331

[21] Appl. No.: 455,496

[22] Filed: May 31, 1995

[51] Int. Cl.[6] ..... A47B 3/00

[52] U.S. Cl. ..... 108/132; 108/131

[58] Field of Search ..... 108/129, 131, 108/132, 133, 127; 248/188.6

[56] References Cited

U.S. PATENT DOCUMENTS

| | | |
|---|---|---|
| 613,298 | 11/1898 | Blakeley . |
| 963,439 | 7/1910 | Hastings . |
| 1,133,662 | 3/1915 | Petrie . |
| 1,203,783 | 11/1916 | Reischmann . |
| 2,459,529 | 1/1949 | Jogwick et al. . |
| 2,481,117 | 8/1949 | Jogwick et al. . |
| 2,514,061 | 7/1950 | Hood . |
| 2,653,066 | 9/1953 | Anderson . |
| 2,690,942 | 10/1954 | Marcus . |
| 3,554,141 | 1/1971 | Burr . |
| 3,695,567 | 10/1972 | Weagle . |
| 3,818,844 | 6/1974 | Burr . |
| 3,845,728 | 11/1974 | Piretti . |
| 4,064,815 | 12/1977 | Baum . |
| 4,139,175 | 2/1979 | Bauer . |
| 4,283,033 | 8/1981 | Bauer . |
| 4,373,334 | 2/1983 | Carlander . |
| 4,444,124 | 4/1984 | Burr . |
| 4,561,622 | 12/1985 | Heinzel . |
| 4,573,415 | 3/1986 | Ramey . |
| 4,658,735 | 4/1987 | Holton . |
| 4,711,184 | 12/1987 | Wallin et al. . |
| 4,827,851 | 5/1989 | Diffrient . |
| 4,838,180 | 6/1989 | Gutgsell . |
| 4,838,181 | 6/1989 | Luyk ..... 108/131 |
| 4,969,619 | 11/1990 | Bauer et al. . |
| 4,979,718 | 12/1990 | Bauer et al. . |
| 5,096,029 | 3/1992 | Bauer et al. . |
| 5,152,646 | 10/1992 | Bauer . |
| 5,188,345 | 2/1993 | Siegner et al. . |
| 5,273,259 | 12/1993 | Bauer et al. . |
| 5,323,713 | 6/1994 | Luky et al. ..... 248/188.6 |

*Primary Examiner*—Peter M. Cuomo
*Assistant Examiner*—Gerald A. Anderson
*Attorney, Agent, or Firm*—Hugh D. Jaeger

[57] ABSTRACT

Folding table system for positive locking of the table leg in a down and locked position or a positive locking of a table leg in the up and locked position where a spring loaded lever operated pawl member automatically engages a rotatable extruded block member to achieve either an uplocked or downlocked position. A secondary safety lock is also provided.

23 Claims, 11 Drawing Sheets

TABLE LEG SYSTEM

CROSS REFERENCES TO CO-PENDING APPLICATIONS

None.

BACKGROUND OF THE INVENTION

1. Field of the Invention

The present invention is for a folding table leg system, and more particularly pertains to a lever operated locking base for a folding table leg.

2. Description of the Prior Art

Practical table legs, such as for boats and other uses, have always been a problem. The legs have been unstable and awkward.

The present invention overcomes the problems of prior art table legs.

SUMMARY OF THE INVENTION

The general purpose of the present invention is a folding table leg system.

According to one embodiment of the present invention, there is provided a folding table leg system, including an extruded rotatable block member having an uplock groove and a downlock groove and a latch member pivotally secured between opposing support brackets. Spring members secured to the latch member bias the latch member for engagement with either a downlock or an uplock groove in the extruded rotatable block member. Actuating levers are secured to the latch member to overcome spring biased engagement of the latch member with the rotatable block member to allow rotation of the rotatable block member and an attached leg member to position the leg between a down and locked position and an up and locked position.

One significant aspect and feature of the present invention is a folding table leg system in which a table leg can be positively locked in an extended or a stowed position. A latch member is held in engagement with an uplock or downlock groove in an extruded rotatable block member by spring force.

Another significant aspect and feature of the present invention is the utilization of actuation levers to simultaneously overcome spring force engagement and to operate a latch member. A latch member pawl having a wedge shape engages either an uplock or a downlock groove in a rotatable block member. The latch member pawl has opposing grooves along its tip which act as a secondary safety catch in conjunction with arced lip members of a downlock groove.

A further significant aspect and feature of the present invention is a folding table leg system which stows in a minimum profile position.

Having thus described embodiments of the present invention, it is the principal object of the present invention to provide a folding table leg system which can lock a leg in both the down and the up position.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
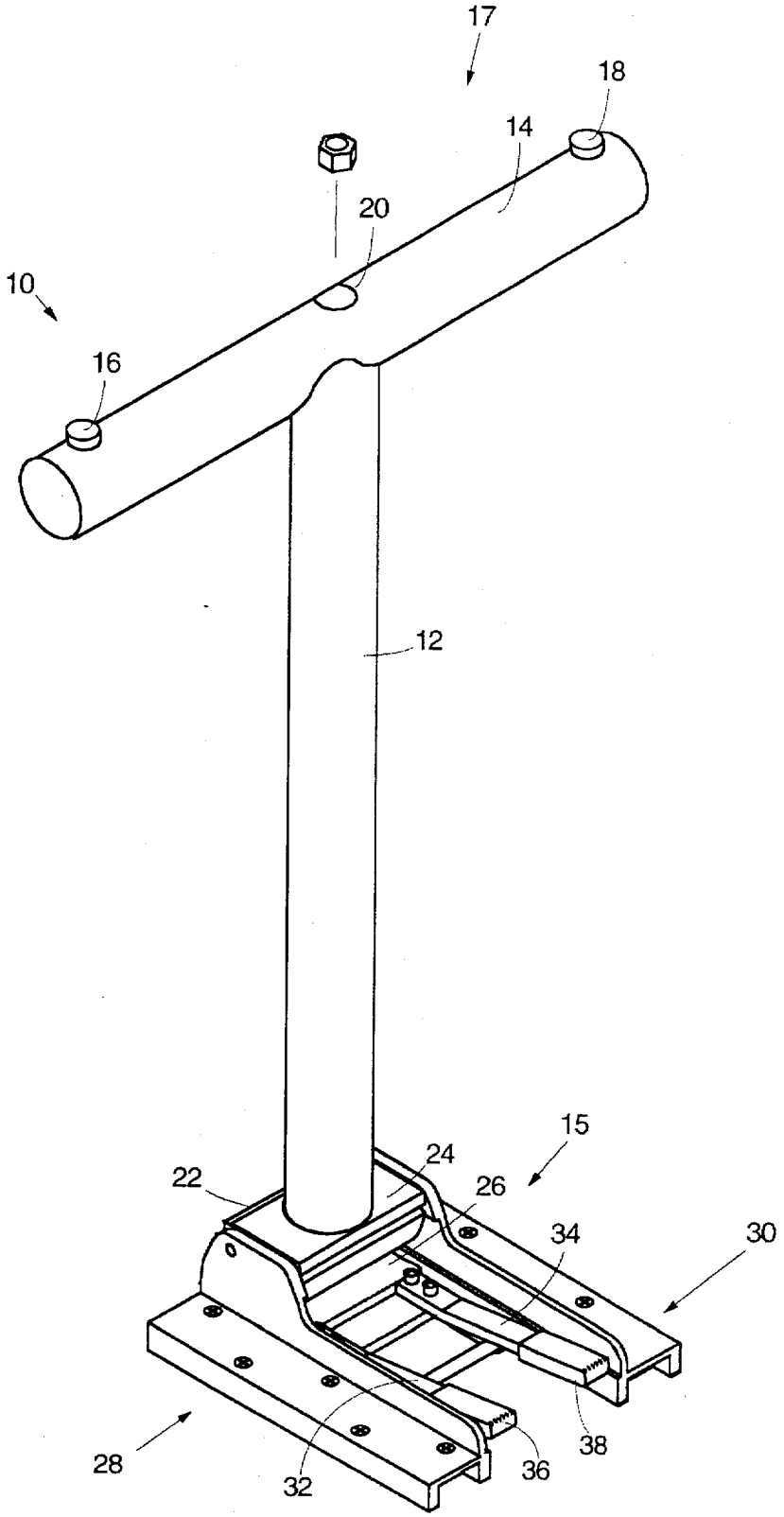
FIG. 1 illustrates an isometric view of a folding table leg system.

FIG. 1 illustrates an isometric view of a folding table leg system 10, the present invention, including a main support tube 12, a horizontal support tube 14 aligned and secured to the main support tube 12 at a right angle, and a locking base 15. The horizontal support tube 14 includes skids 16 and 18 of metal, rubber or plastic located at the ends of the horizontal support tube 14, and an access hole 20 in alignment with the longitudinal axis of the main support tube 12. The main support tube 12 and the horizontal support tube 14 form a table leg 17 which secures to and rotates about the locking base 15.

The locking base 15 includes an extruded rotatable block member 24 and a latch member 26 each pivotally supported between left and right angled mirror image-like support brackets 28 and 30. Angled actuating levers 32 and 34, having pliable plastic end caps 36 and 38, secure to the latch member 26. The latch member 26 is spring loaded to engage either an uplock or a downlock groove in the extruded rotatable block member 24, as later described in detail.

Figure 2:
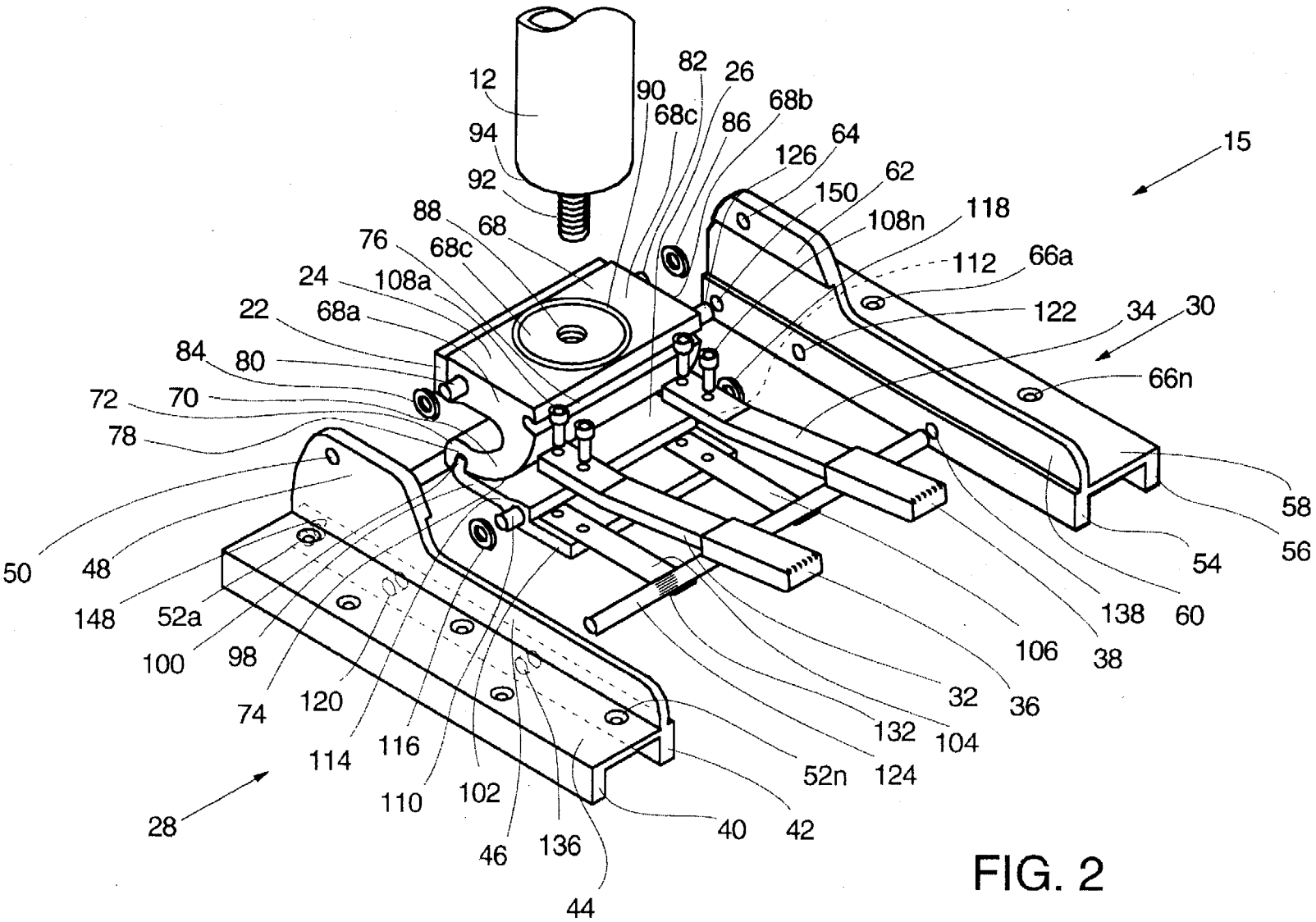
FIG. 2 illustrates an exploded isometric view of a locking base.

FIG. 2 illustrates an isometric exploded view of the locking base 15 where all numerals correspond to those elements previously described. The one-piece support bracket 28 includes vertical planar members 40 and 42, an interceding horizontal planar member 44 aligned between the vertical planar members 40 and 42, and a vertical planar member 46 extending vertically from the horizontal planar member 44. The vertical planar member 46 includes an upper reinforced thicker area 48 having a horizontally aligned pivot hole 50. A plurality of recessed anchoring holes **52*a*–52*n* along the horizontal planar member 44 allow for the mounting of the support bracket 28** to the undersurface of a table by the use of appropriate fasteners.

In a like manner, the one-piece support bracket 30 is constructed in a similar fashion to include vertical planar members 54 and 56, an interceding horizontal planar member 58 aligned between the vertical planar members 54 and 56, and a vertical planar member 60 extending vertically from the horizontal planar member 58. The vertical planar member 60 includes an upper reinforced thicker area 62 having a horizontally aligned pivot hole 64. A plurality of recessed anchoring holes 66a–66n along the horizontal planar member 58 allow for the mounting of the support bracket 30 to the underside of a table by the use of appropriate fasteners.

The rotatable block member 24 includes a substantially rectangular solid-like block member 68 having an interrupted arcuate member 70 descending from one edge of the substantially rectangular solid-like block member 68 to terminate in a smaller radiused end member 72. The arcuate member 70 includes an arcuate surface 74 interrupted near its top by a horizontally aligned downlock groove 78. The arcuate surface 74 is also interrupted near the smaller radiused end member 72 by a horizontally aligned uplock groove 76. Dowel pin pivots 80 and 82, being the centers for the arcuate surface 74 and for rotation of the rotatable block member 24, extend outwardly and horizontally from the sides 68a and 68b of the block member 68 to accommodate washers 84 and 86 and horizontally aligned pivot holes 50 and 64 in the upper reinforced thicker areas 48 and 62 of the support brackets 28 and 30, respectively. A threaded hole 88 and an annular groove 90 align through the planar surface 68c in the block member 68 to mountingly accommodate and serve as a securement base for the threaded rod 92 and for the tubular edge 94 of the main support tube 12, respectively. A nut 96, illustrated in FIG. 1, gains access to the interior of the horizontal support tube 14 and the main support tube 12. A finger and hand grasping surface and area 69 of a predetermined geometrical configuration provides for rotational movement of the system.

The latch member 26 is extruded as a one-piece member which resembles the mating of two planar members, one of which includes a pawl. One such planar member 98 includes a pawl 100 extending at an angle from the planar member 98 to automatically engage either the downlock groove 78, as illustrated, or to engage the uplock groove 76 subsequent to rotational movement of the rotatable block member 24. The other planar member 102 serves as a mount for spring members 104 and 106 and actuating levers 32 and 34 which are secured by a plurality of fasteners 108a–108n passing through the spring members 104 and 106 and actuating levers 32 and 34 to secure to the planar member 102. Dowel pin pivots 110 and 112, as also illustrated in FIG. 3, extend from the thick area 114 formed by the planar members 98 and 102 to fit and align within spacer washers 116 and 118 and holes 120 and 122 in the vertical planar members 42 and 54 of the support brackets 28 and 30, respectively.

Horizontally aligned pins 124 and 126, having fluted engagement surfaces, extend between and frictionally engage the support brackets 28 and 30 to capture the rotatable block member 24 and the latch member 26 and their associated members. With additional reference to FIG. 3, the ends of pin 124 are aligned in holes 128 and 130 in vertical planar members 40 and 56, and the fluted engagement surfaces 132 and 134 at the intermediate areas of the pin 124 frictionally engage holes 136 and 138 in vertical planar members 42 and 54. In a similar fashion, the ends of pin 126 are aligned in holes 140 and 142 in the opposing ends of vertical planar members 40 and 56, and the fluted engagement surfaces 144 and 146 at the intermediate areas of pin 126 frictionally engage holes 148 and 150 in the vertical planar members 42 and 54. Pin 124, in addition to serving as a structural tie member, also serves as a spring tension facilitator. Spring members 104 and 106 extend from the latch member 26 to a position beneath the pin 124 in a manner to cause upward rotational positioning of the pawl 100, as viewed in FIG. 2, about dowel pin pivots 110 and 112 into the downlock groove 78, or alternately of the pawl 100 into the uplock groove 76. Actuating levers 32 and 34 are angled upwardly, as viewed, to clear pin 124 and to allow the user finger insertion room between the ends of the actuating levers 32 and 34 and the lower table surface so that actuation may be accomplished. A protective rubber member 22 secures to one edge of the rotatable block member 24 for stacking of tables when the horizontal support tube 14 is in the up and locked position.

Figure 3:
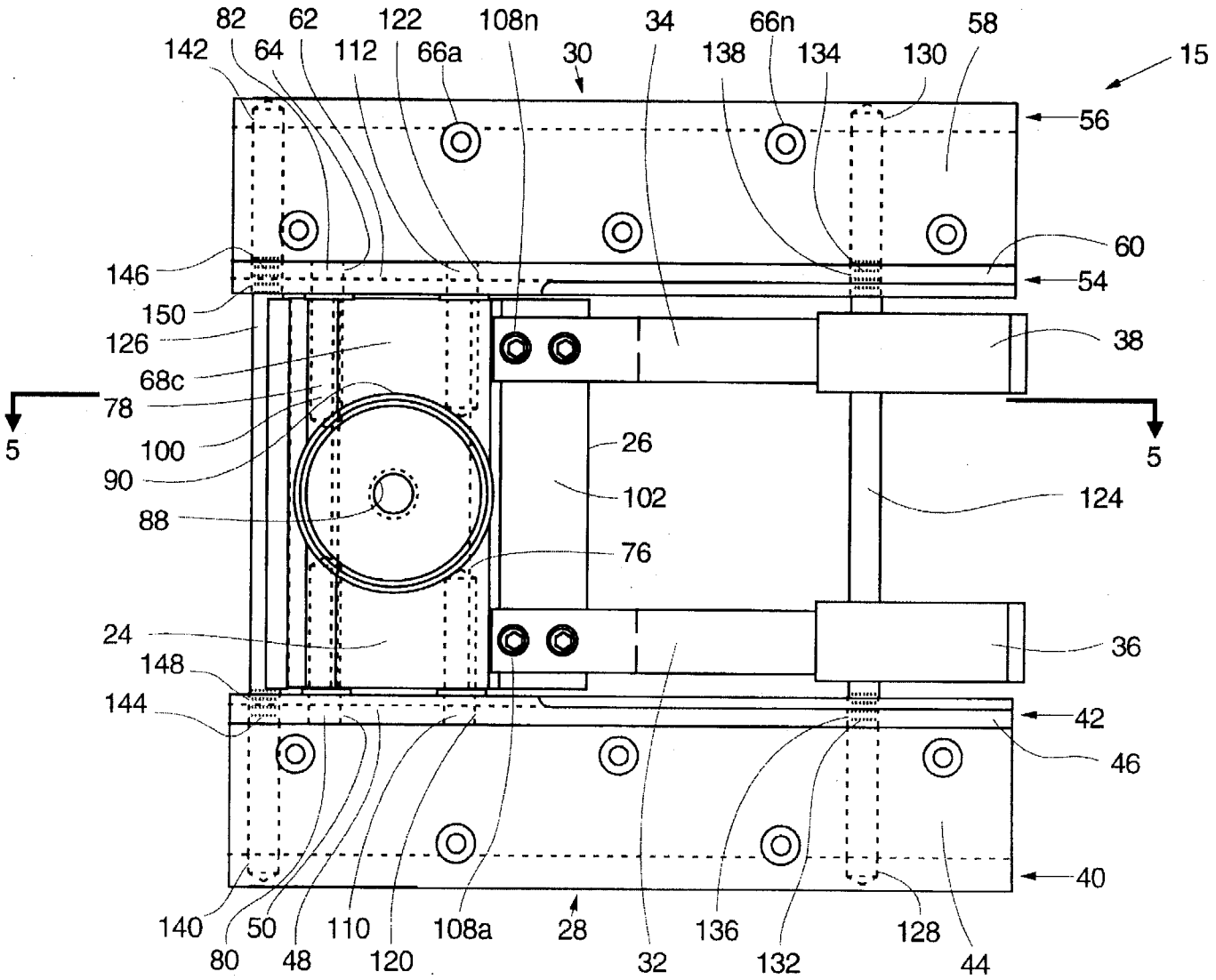
FIG. 3 illustrates a top view of the locking base.

FIG. 3 illustrates a top view of the locking base 15 where all numerals correspond to those elements previously described. Illustrated in particular are the horizontal pins 124 and 126 in frictional engagement with the support brackets 28 and 30 to cause capture of the rotatable block member 24 and latch member 26 therebetween.

Figure 4:
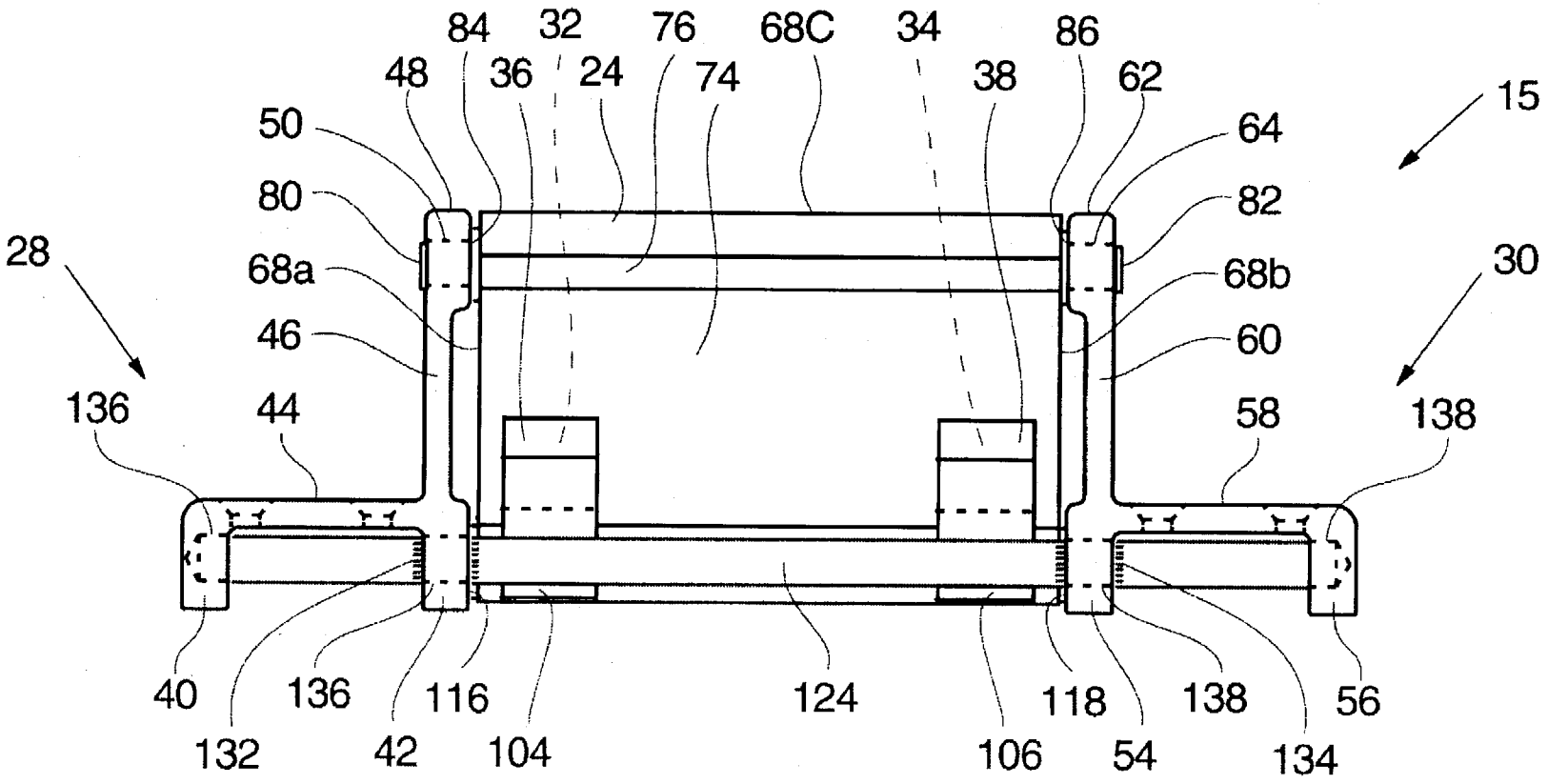
FIG. 4 illustrates a right end view of the locking base.

FIG. 4 illustrates a right end view of the locking base 15 where all numerals correspond to those elements previously described.

Figure 5:
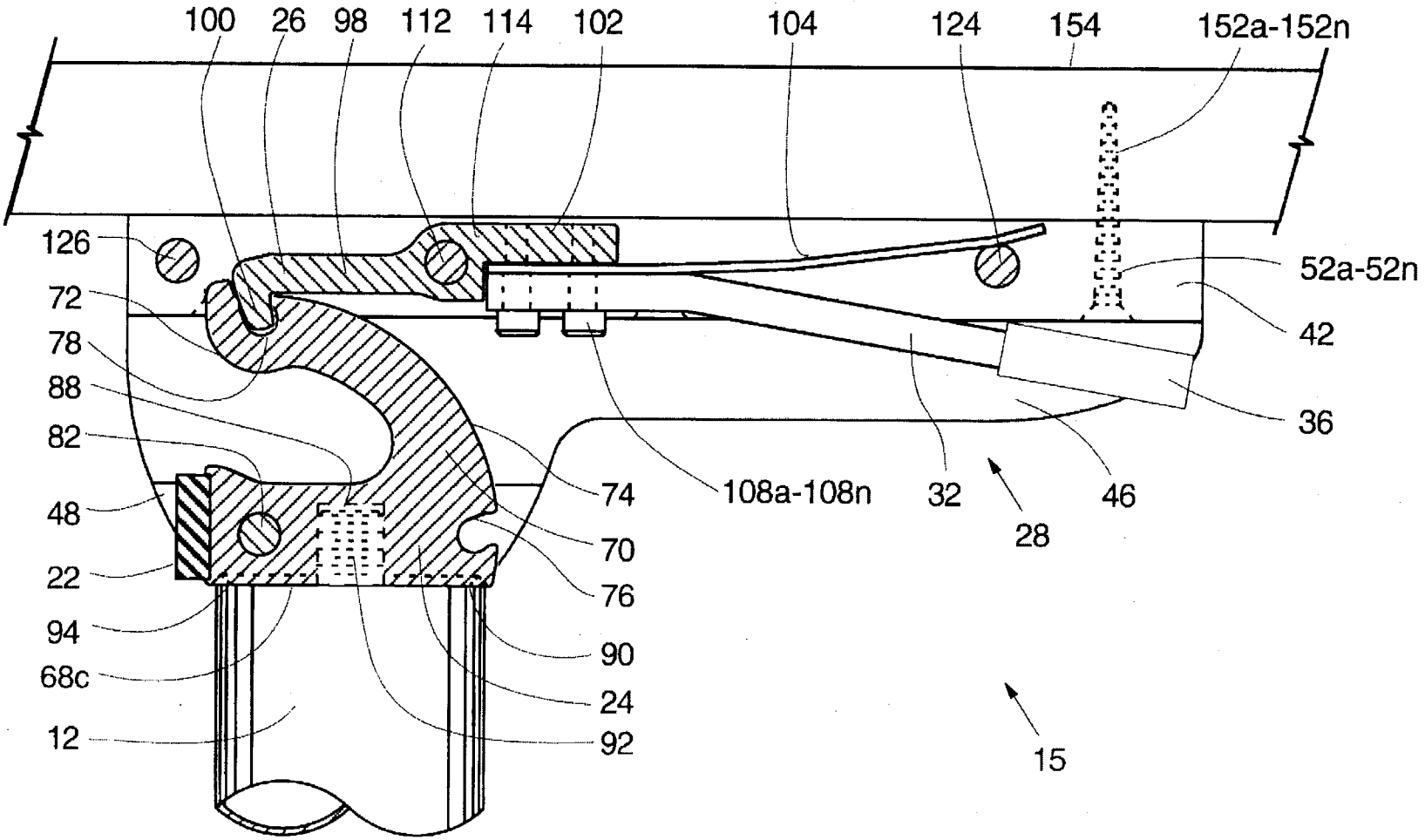
FIG. 5 illustrates an inverted cross sectional view along line 5—5 of FIG. 3 of the locking base with a main support tube in the down and locked position.
Figure 6:
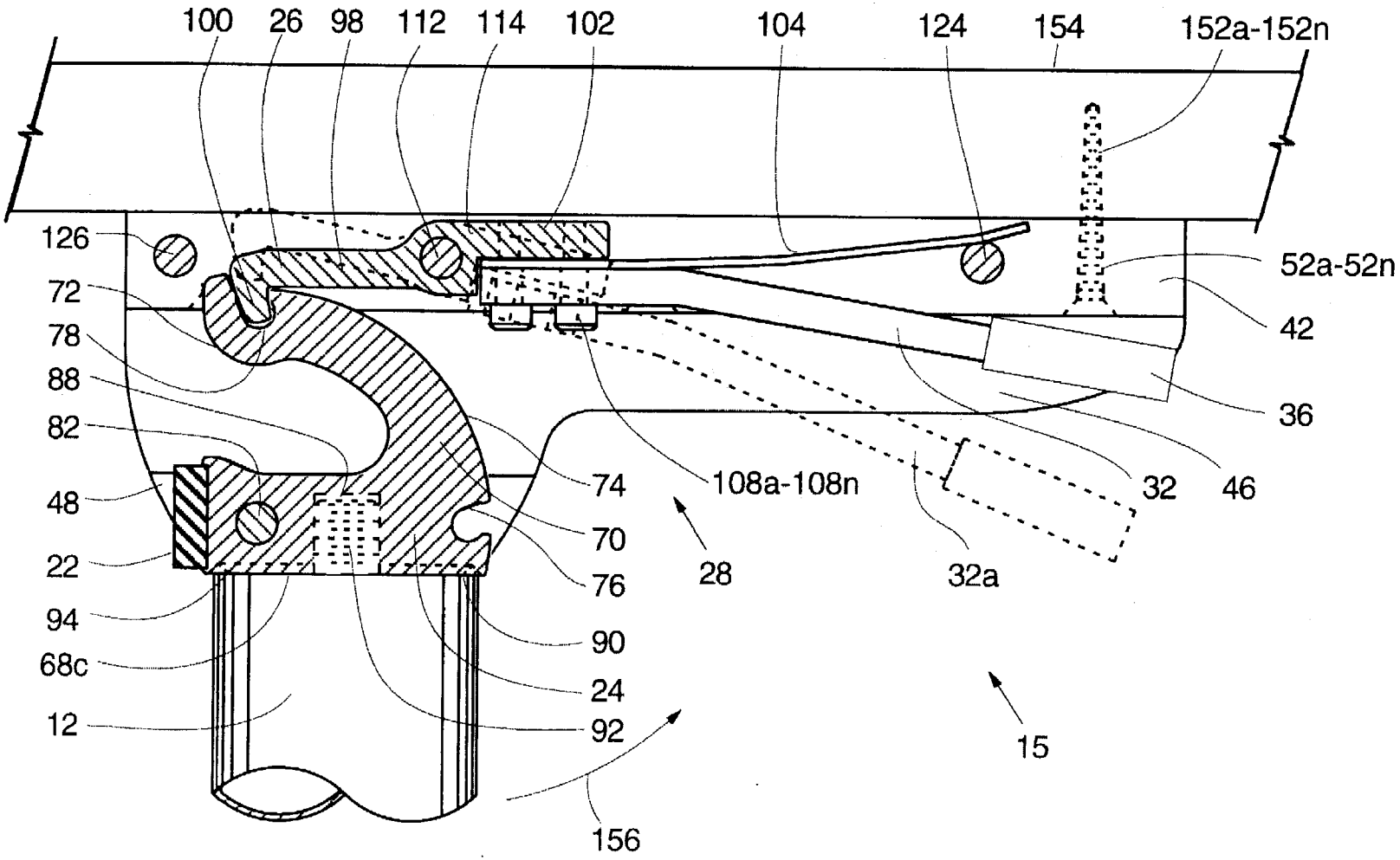
FIG. 6 illustrates the locking base of FIG. 5 and the disengagement of the pawl from the rotatable block member.
Figure 7:
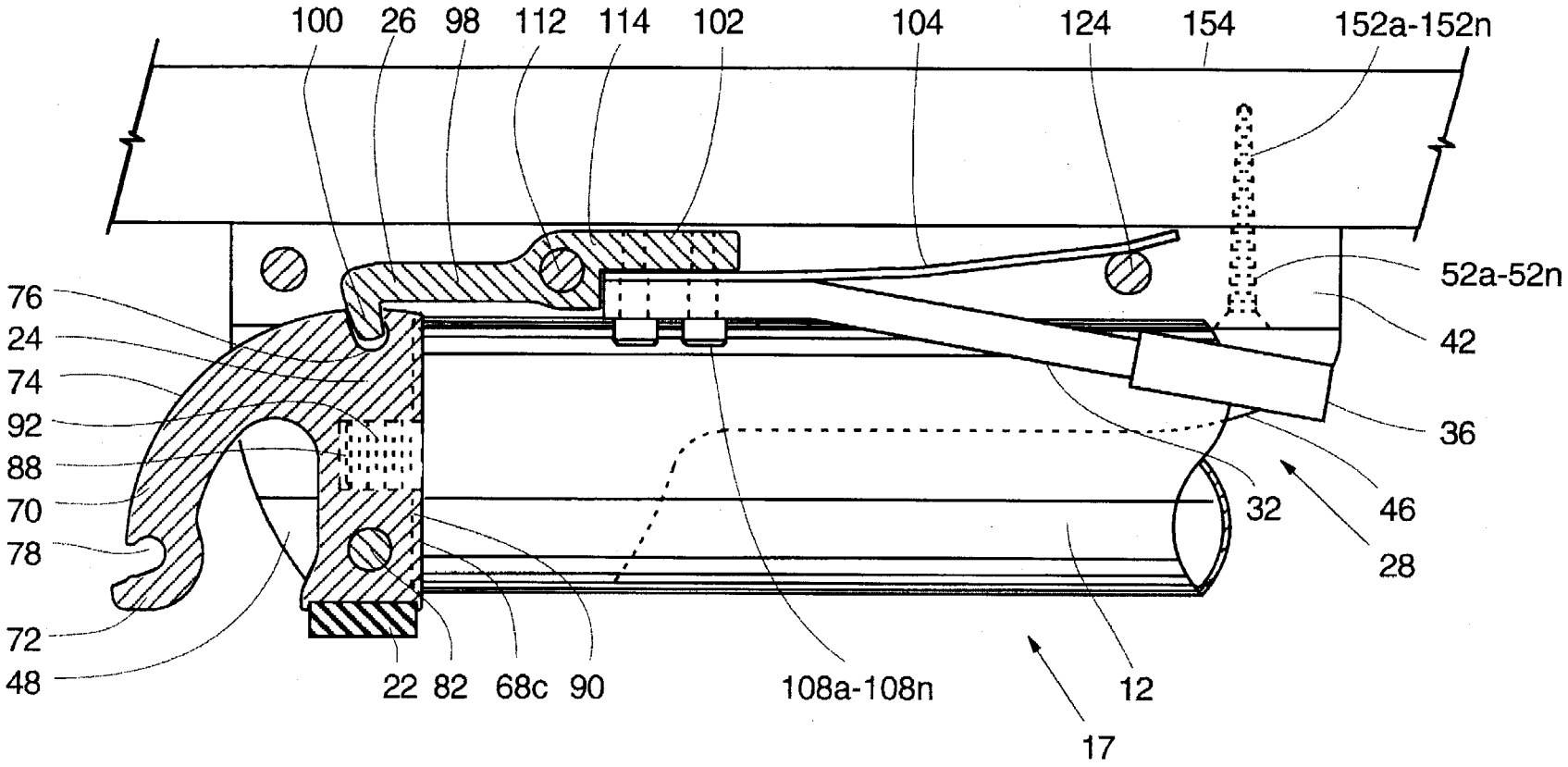
FIG. 7 illustrates the locking base of FIG. 5 with the main support tube in the up and locked position.

FIGS. 5, 6 and 7 best illustrate the mode of operation of the locking base 15.

FIG. 5 illustrates an inverted cross sectional view of the locking base 15 with the main support tube 12 in the down and locked position along line 5—5 of FIG. 3, where all numerals correspond to those elements previously described. The locking base 15 secures by fasteners 152a–152n through support brackets 28 and 30 to a planar table member 154. Pawl 100, having angled sides, is illustrated in wedge-like engagement with the downlock groove 78 in the rotatable block member 24 to maintain the rotatable block member 24, and thus the horizontal support tube 14 and the main support tube 12, in the down and locked position, as illustrated. The angled sides of the pawl 100 are driven by force of spring members 104 and 106 into wedge-like contact with two opposing surfaces of the downlock groove 78, as illustrated in detail in FIG. 8.

FIG. 6 illustrates the locking base 15 of FIG. 5 with the actuating lever 32 depressed to disengage the pawl 100 from the downlock groove 78 of the rotatable block member 24 so that the rotatable block member 24, main support tube 12, and attached horizontal support tube 14 can be pivoted about the dowel pin pivots 82 and 80. The actuated position of actuating lever 32 is illustrated in dashed lines and referenced as 32a. Actuation of either actuating lever 32 or actuating lever 34 causes the latch member 26 to rotate about the dowel pin pivots 112 and 110, thereby removing the pawl 100 from influence of the downlock groove 78. Upon release of the rotatable block member 24 from the latch member pawl 100, the main support tube 12 and the horizontal support tube 14, which form table leg 17, are swung as indicated by arrow 156 toward a position parallel to the planar table member 154 to automatically engage the uplock groove 76 at the opposing end of the arcuate surface 74. Spring pressure provided by spring members 104 and 106 causes the pawl 100 to slidingly traverse the arcuate surface 74 until spring forced engagement of the pawl 100 with the uplock groove 76 is effected, as illustrated in FIG. 7.

FIG. 7 illustrates the locking base 15 of FIG. 5 having the rotatable block member 24 in the up and locked position where all numerals correspond to those elements previously described. As previously described, actuating levers 32 and 34 were previously depressed allowing disengagement of the pawl 100 from the downlock groove 78 to allow positioning of the table leg 17 parallel to the planar table member 154, as illustrated. Spring members 104 and 106 forcibly position the pawl 100 into wedge-like forced engagement with the uplock groove 76 to lock the table leg 17 in the folded and stowed position. The folded and stowed position of the table leg 17 provides for leg stowage in very close proximity to the undersurface of the table. This close-in leg stowage offers a very low profile which is highly desirable when stacking of tables incorporating the folding table leg system. Placement of the dowel pin pivots 80 and 82 at a distance from rather than closer to the table underside is of great significance with respect to obtaining a low profile leg stowage. If, for instance, a pivot point were placed at a point closer to the table undersurface or closer to the table center, stowage with a greater profile would be the likely outcome.

Figure 8:
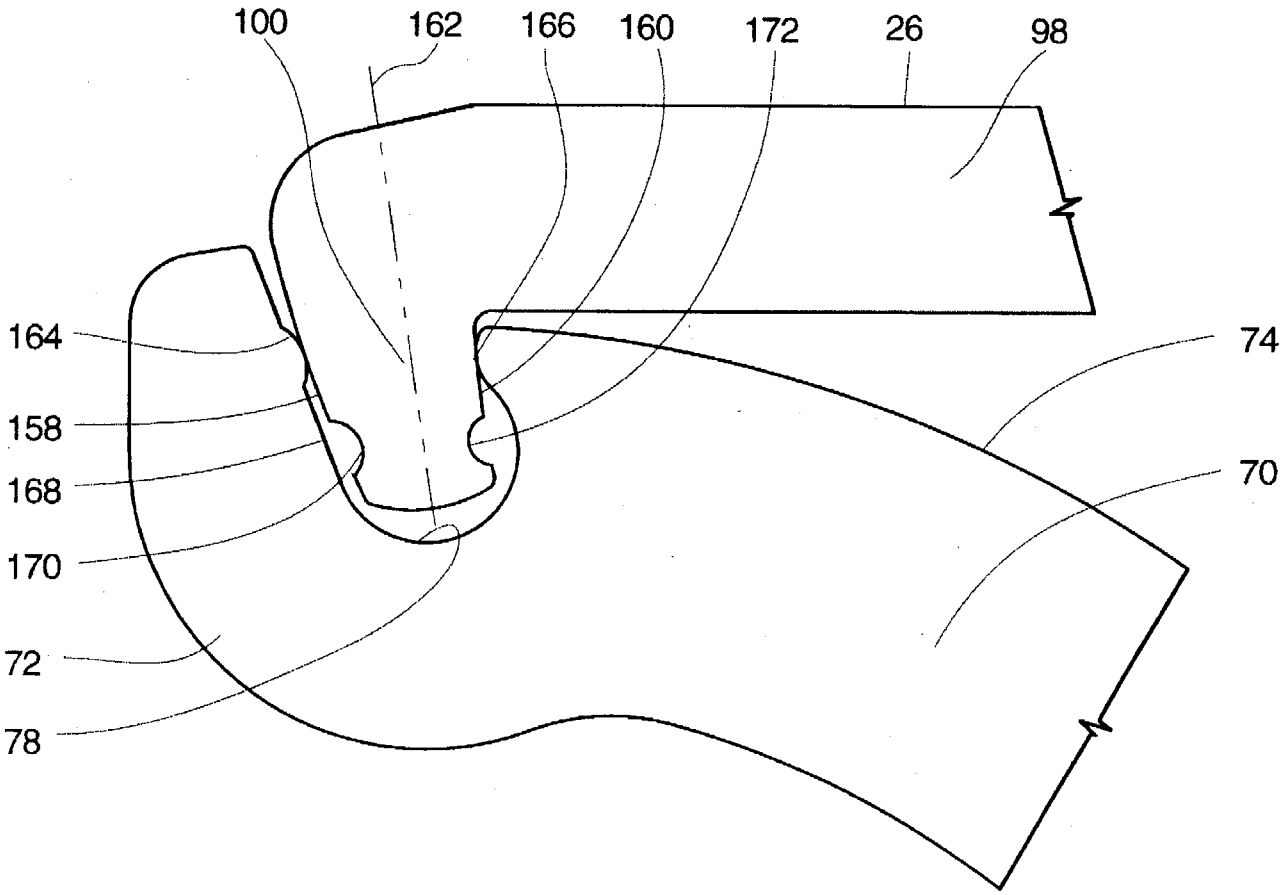
FIG. 8 illustrates the engagement of the pawl with the downlock groove.

FIG. 8 illustrates the engagement of the pawl 100 of the latch member 26 with the downlock groove 78 of the rotatable block member 24, where all numerals correspond to those elements previously described. The pawl 100 includes surfaces 158 and 160 which are angularly displaced approximately the same amount from the pawl center line 162 to form a wedge. The tension of the spring members 104 and 106 forces the tapered and angled surfaces 158 and 160 of the pawl 100 into wedge-like engagement with horizontally extending arced lips 164 and 166. Constant force wedge-like engagement of the pawl 100 into the downlock groove 78 provides for secured rigidity of the table leg 17, without looseness or sloppiness, with respect to the planar table member 154 illustrated in FIG. 10. Arced lip 166 is located at the junction of the arcuate surface 74 and the downlock groove 78. The other arced lip 164 is located in opposition to the arced lip 166 on the planar surface 168 of the downlock groove 78. Component wear is accounted for in the design of the pawl 100 and the downlock groove 78 and adjacent areas. Should wear occur where the arced lips 164 and 166 contact the angled pawl surfaces 158 and 160, spring tension is available to drive the wedge-like pawl 100 deeper into the downlock groove 78 to ensure plumb and well secured alignment of the main support tube 12.

Arced lips 164 and 166 also provide a secondary locking function in that if excess side loads are introduced to the table leg 17, horizontally aligned groove 170 or 172 at the lower portions of pawl surfaces 158 and 160 will catch and engage arced lip 164 or 166, respectively, if the pawl 100 is forced upwardly and outwardly from the downlock groove 78 by displacement of the table leg 17 and corresponding displacement of the rotatable block member 24. This engagement prevents collapse of the table leg 17, thereby holding the table leg 17 upright in an uncollapsed position with only a slight deviation from plumb vertical alignment.

Figure 9:
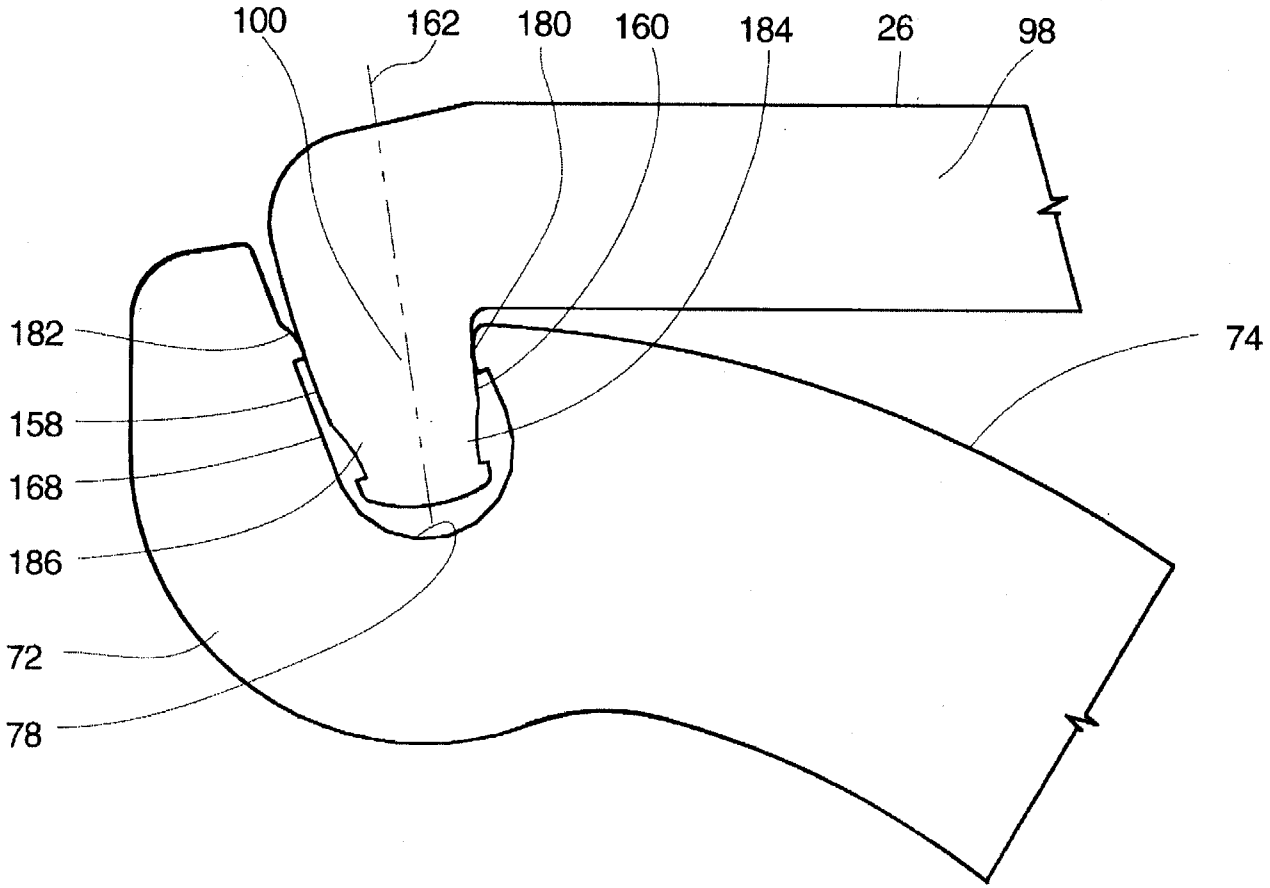
FIG. 9, an alternative embodiment, illustrates the engagement of the pawl with the downlock groove where hook and latch safety catches are utilized.

FIG. 9, an alternative embodiment, illustrates the engagement of a pawl 100 of the latch member 26 with the downlock groove 78 of the rotatable block member 24 where all numerals correspond to those elements previously described. In this illustration, hook and latch members have been incorporated in lieu of arced lips 164 and 166 and grooves 170 and 172 to effect a positive locking method should leg side loads occur. As in FIG. 8, the pawl 100 includes surfaces 158 and 160 which are angularly displaced the same amount from the pawl center line 162 to form a wedge. The tension of the spring members 104 and 106 forces the tapered and angled surfaces 158 and 160 of the pawl 100 into wedge-like engagement with horizontally extending and protruding semi-circular profile hook members 180 and 182 which resemble a half portion of the arced lips 164 and 166 of FIG. 8. The semi-circular hook member 180 is located at the junction of the arcuate surface 74 and the downlock groove 78. The other semi-circular hook member 182 is located in opposition to the semi-circular hook member 180 on the planar surface 168 of the downlock groove 78. Component wear is accounted for in the design of the pawl 100 and the downlock groove 78 and adjacent areas. Should wear occur where the semi-circular hook members 182 and 180, respectively, contact the angled surfaces 158 and 160, spring tension is available to drive the wedge-like pawl 100 deeper into the downlock groove 78 to ensure plumb and well secured alignment of the main support tube 12. Semi-circular hook members 180 and 182 also provide a positive secondary locking function in that if excessive side loads are introduced to the table leg 17, horizontally aligned semi-circular latch members 184 and 186 at the lower portions of pawl surface 160 or 158 will catch and engage the semi-circular hook member 180 or 182, respectively, if the pawl 100 is forced upwardly and outwardly from the downlock groove 78 by displacement of the table leg 17 and corresponding displacement of the rotatable block member 24. This positive hook- and latch-like engagement prevents collapse of the table leg 17, thereby holding the table leg 17 upright in an uncollapsed position with only a slight deviation from plumb vertical alignment.

Figure 10:
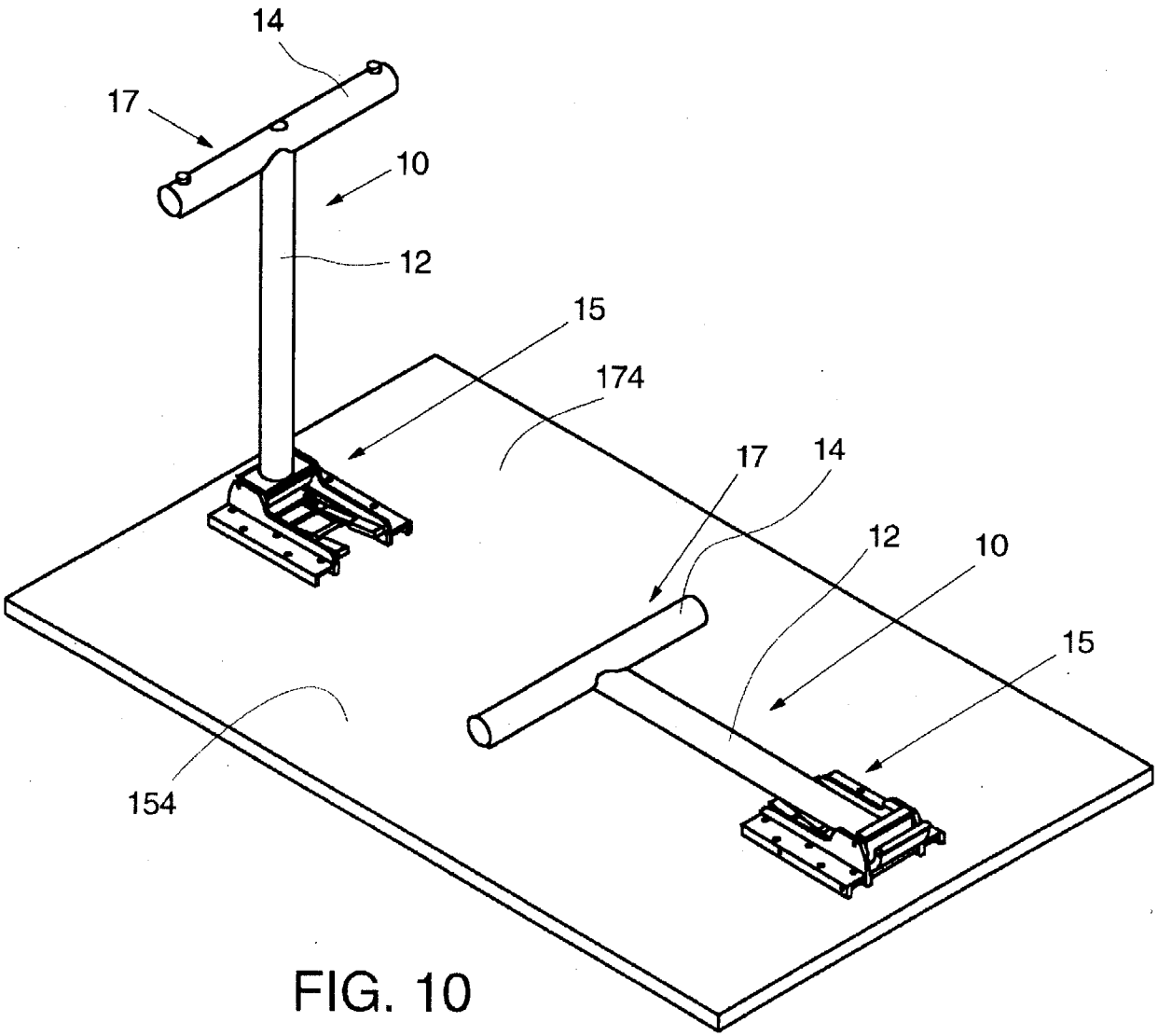
FIG. 10 illustrates table legs secured in the up and locked and in the down and locked positions on a table surface; and, FIG. 11 illustrates a comparative example of the use of the present invention to provide for space saving and use in short length tables.

FIG. 10 illustrates a table leg 17 secured to the lower planar surface of planar table member 154 of a table top 174 and erected and locked into an extended position by the locking base 15. Also illustrated is a table leg 17 folded over into a stowed position parallel to the lower planar surface of planar table member 154 and locked into the parallel position by the locking base 15.

Figure 11:
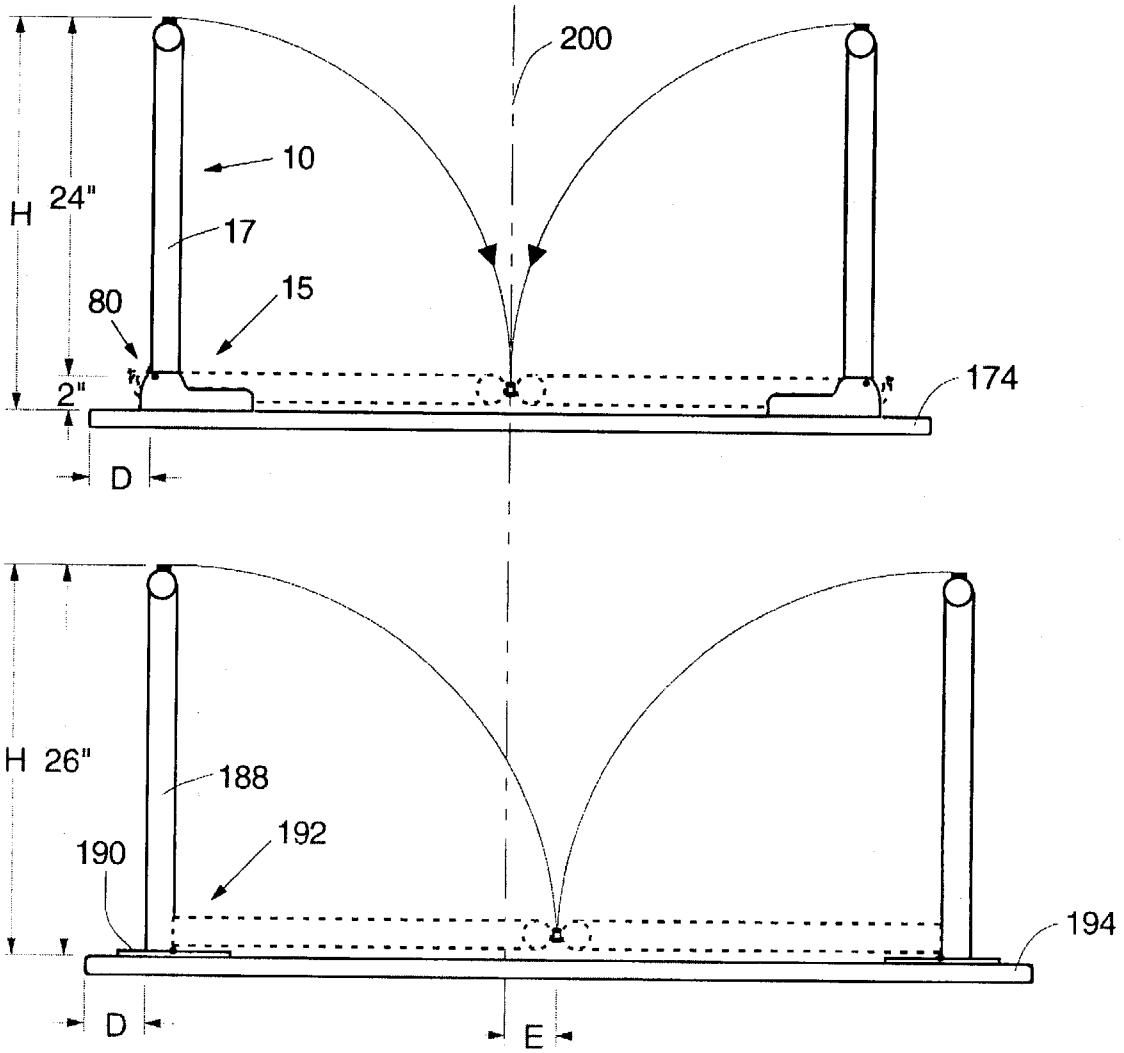

FIG. 11 illustrates an example of the use of the present invention with a table of minimum length as compared to other style or generic leg pivot or locking devices. The location of the pivot point 81 created by the dowel pin pivots 80 (and 82) away from the bottom surface of the table top is of great importance when incorporating the folding table leg system 10. The locking base 15 is positioned to locate the table leg 17 at a fixed distance D from the edge of the table top 174 as is a generic table leg 188 and a generic hinge 190 having a pivot 192 on a generic table top 194. Each table leg 17 and 188 provides for a common and equal height H between the lower table surface and the lower part of each table leg which sets on the floor. It can be seen that the length of table leg 17, incorporated in the present invention, is shorter than the length of generic table leg 188. For sake of discussion, assume that the pivot point 81 is 2 inches from the table undersurface and the length of the table leg 17 is 24 inches, thus providing support for the bottom of the table top 174 at 26 inches above the floor. Assume that pivot point 192 of the generic table leg 194 is flush with the lower surface of the generic table top 194—both table legs 17 and 188 are then pivoted about their respective pivot points 81 and 192 toward the center of their respective table top lower surfaces. Table leg 17 swings about a 24-inch radius arc and meets the table tangent to reference line 200, while table leg 188 swings about a 26-inch radius arc to pass through the reference line 200. This distance, shown as extra distance E, is the required distance used by one generic table leg. Of course, the extra room required for two generic table legs would be twice the designated extra distance E or 2 X E. Thus, it can be seen that the folding table leg system 10, the present invention, can be utilized for use in short length tables by virtue of the ability to require less space when folded for storage. Minimum distance between two extended table legs is achieved by utilization of the present invention.

TABLE LEG SYSTEM

PARTS LIST

| TABLE LEG SYSTEM PARTS LIST | |
|---|---|
| 10 | folding table system |
| 12 | main support tube |
| 14 | horizontal support tube |
| 15 | locking base |
| 16 | skid |
| 17 | table leg |
| 18 | skid |
| 20 | access |
| 22 | protective rubber member |
| 24 | rotatable block member |
| 26 | latch member |
| 28 | support bracket |
| 30 | support bracket |
| 32 | actuating lever |
| 34 | actuating lever |
| 36 | end cap |
| 38 | end cap |
| 40 | vertical planar member |
| 42 | vertical planar member |
| 44 | horizontal planar member |
| 46 | vertical planar member |
| 48 | reinforced thicker area |
| 50 | pivot hole |
| 52a–n | holes |
| 54 | vertical planar member |
| 56 | vertical planar member |
| 58 | horizontal planar member |
| 60 | vertical planar member |
| 62 | reinforced thicker area |
| 64 | pivot hole |
| 66a–n | holes |
| 68 | block member |
| 68a–b | sides |
| 68c | planar surface |
| 70 | arcular member |
| 72 | end member |
| 74 | arcular surface |
| 76 | uplock groove |
| 78 | downlock groove |
| 80 | split spring pin |
| 82 | split spring pin |
| 84 | washer |
| 86 | washer |
| 88 | threaded hole |
| 90 | annular groove |
| 92 | threaded rod |
| 94 | tubular edge |
| 96 | nut |
| 98 | planar member |
| 100 | pawl |
| 102 | planar member |
| 104 | spring member |
| 106 | spring member |
| 108a–n | fasteners |
| 110 | split spring pin |
| 112 | split spring pin |
| 114 | thick area |
| 116 | spacer washer |
| 118 | spacer washer |

-continued

| TABLE LEG SYSTEM PARTS LIST | |
|---|---|
| 120 | hole |
| 122 | hole |
| 124 | pin |
| 126 | pin |
| 128 | hole |
| 130 | hole |
| 132 | fluted engagement surfaces |
| 134 | fluted engagement surfaces |
| 136 | hole |
| 138 | hole |
| 140 | hole |
| 142 | hole |
| 144 | fluted engagement surfaces |
| 146 | fluted engagement surfaces |
| 148 | hole |
| 150 | hole |
| 152a–n | fasteners |
| 154 | planar table member |
| 156 | arrow |
| 158 | pawl surface |
| 160 | pawl surface |
| 162 | pawl center line |
| 164 | arced lips |
| 166 | arced lips |
| 168 | planar surface |
| 170 | groove |
| 172 | groove |
| 174 | table top |
| 180 | semi-circular hook member |
| 182 | semi-circular hook member |
| 184 | semi-circular hook member |
| 186 | semi-circular hook member |
| 188 | generic leg |
| 190 | generic hinge |
| 192 | pivot |
| 194 | table top |
| 196 | |
| 198 | |
| 200 | reference line |

Various modifications can be made to the present invention without departing from the apparent scope hereof.

I claim:

1. A folding table leg system comprising:

a. a horizontal support tube;

b. a main support tube, secured, at a first end, to the horizontal support tube;

c. a rotatable block member including:

(1) an annular surface secured to a second end of the main support tube;

(2) opposing split spring pins extending horizontally from the block member and defining an axis of rotation for the block member;

(3) an arcular member extending from the rotatable block member opposite the main support tube, the arcular member having an exterior arcular surface centered about the axis of rotation of the rotatable block member and an inner surface defining, with the rotatable block member, a finger grasping space therebetween;

(4) a downlock groove in the arcular surface of the arcular member; and, (5) an uplock groove in the arcular surface of the arcular member;

d. a planar member including:

(1) split spring pins extending horizontally from the planar member and defining a pivot axis;

(2) at least one spring member urging the planar member against the arcular surface;

(3) at least one actuating lever extending from the planar member for urging the planar member away from the arcular surface; and, (4) a pawl extending from the planar member toward the arcular surface and situated to engage either the downlock groove or the uplock groove when either groove is rotationally aligned with the pawl; and, e. opposing support brackets including upwardly vertical planar members for attachment to an undersurface of a table underside a table, the support brackets having spaced apart and aligned receptors for the split spring pins of the rotatable block member and the planar member so as to allow the main support tube to be locked in a horizontal position when the pawl engages the uplock groove or a vertical position when the pawl engages the downlock groove.

2. A combination hinge and angular position lock mechanism for mounting and angular position locking of a folding leg to a table, comprising:

a. a frame including:

(1) a table mounting surface and means for mounting the table mounting surface to an underside of a table, (2) a rotation axis, parallel to and spaced apart from the table mounting surface, and, (3) a pivot axis, parallel to and spaced apart from the rotation axis;

b. a rotatable block member, rotatably carried on the rotation axis, including:

(1) a leg mounting surface, and, (2) an arcular extension extending from the rotatable block member opposite the leg mounting surface and having at least one lock groove in the arcular extension, the lock groove situate parallel to and spaced apart from the rotation axis;

c. a latch member, pivotally mounted on the pivot axis, and including:

(1) a pawl arranged for engagement of the groove of the rotatable block member, (2) spring means urging the pawl into engagement with the groove to lock rotation of the rotatable block member, and, (3) a release lever to urge the pawl, against the spring means and out of engagement with the groove of the rotatable block member, thereby allowing the block member to rotate on the rotation axis;

d. wherein the plurality of grooves of the rotatable block included:

(1) first groove, located radially opposite the leg mounting surface of the rotatable block, and wherein engagement of the first groove by the pawl locks the leg mounting surface of the rotatable block parallel to and spaced apart from the table mounting surface of the frame, and, (2) a second groove, located adjacent the rotatable block on the arcular extension member and wherein engagement of the pawl within the second groove locks the leg mounting surface of the rotatable block generally perpendicular to the mounting surface of the frame; and, e. a resilient protective member secured upon the rotatable block, the protective member being located generally opposite the second groove such that the protective member is deployed most distantly from the mounting surface of the frame when the leg mounting surface of the rotatable block is perpendicular to the mounting surface of the frame.

3. The combination mechanism of claim 2, wherein the lock groove, pawl, and spring means, together, further include:

a. wear compensating means to maintain a substantially constant angular relationship between the rotatable block member and the frame, as the pawl and groove are subjected to wear.

4. The combination mechanism of claim 3, wherein the pawl defines a pawl centerline and the wear compensating means includes coordinated paired lips extending toward each other from opposite faces of the groove and coordinated angular wedge surfaces on the pawl, such that combined wear of the lips and angular wedge surfaces is compensated for by deeper insertion of the pawl into the groove so as to maintain the pre-wear angular relationship between the pawl centerline and the rotating block.

5. The combination mechanism of claim 4, further comprising:

a. safety hook members on the pawl, the safety hook members arranged such that one or the other is subject to capture and interception by one of the paired lips of the groove in an occurrence of an unintended initiation of off pawl axis bias withdrawal of the pawl from the groove.

6. The mechanism of claim 2, wherein the protective member on the rotatable block extends past the frame when the second groove is engaged.

7. The mechanism of claim 2, further comprising a protective member secured upon the rotatable block, the protective member being deployed most distantly from the mounting surface of the frame when the leg mounting surface of the rotatable block is perpendicular to the mounting surface of the frame.

8. The mechanism of claim 2, wherein the release lever is moved away from the table mounting surface to release the pawl from the groove.

9. The mechanism of claim 2, wherein the groove is one of a plurality of grooves on the arcular member.

10. The mechanism of claim 2, wherein the pawl is between the table mounting surface and the rotation axis.

11. The mechanism of claim 2, wherein the rotatable block and the arcular member extending from opposite the leg mounting surface of the rotatable block define a finger insert region of the rotatable block.

12. A folding table system, comprising a. a planar table member, the planar table member having a work surface and a undersurface, opposite the work surface;

b. a locking base fastened to the undersurface of the planar table member, the locking base including:

(1) a frame, the frame having:

(a) a table mounting surface, contacting the undersurface of the planar table member, (b) a rotation axis, parallel to and spaced apart from the table mounting surface, and, (c) a pivot axis, parallel to and spaced apart from the rotation axis;

(2) a rotatable block member, rotatably carried on the rotation axis, including:

(a) a leg mount, and, (b) an arcular extension extending from the rotatable block member opposite the leg mount and having at least one lock groove in the arcular extension, the lock groove situate parallel to and spaced apart from the rotation axis; and, (3) a latch member, pivotally mounted on the pivot axis, and including:

(a) a pawl arranged for engagement of the groove of the rotatable block member, (b) spring means urging the pawl into engagement with the groove to lock rotation of the rotatable block member, and, (c) a release lever to urge the pawl, against the spring means and out of engagement with the groove of the rotatable block member, thereby allowing the block member to rotate on the rotation axis; and, c. wherein the rotatable block and the arcular member extending from opposite the leg mount of the rotatable block define a finger insert region of the rotatable block.

13. The table system of claim 12, wherein the groove is one of a plurality of grooves on the arcular member.

14. The table system of claim 13, wherein the plurality of grooves of the rotatable block comprise:

a. a first groove, located radially opposite the leg mount of the rotatable block, and wherein engagement of the first groove by the pawl locks the leg mount of the rotatable block parallel to and spaced apart from the table mounting surface of the frame; and, b. a second groove, located adjacent the rotatable block on the arcular extension member and wherein engagement of the pawl within the second groove locks the leg mount of the rotatable block generally perpendicular to the mounting surface of the frame.

15. The table system of claim 14, further comprising a resilient protective member secured upon the rotatable block, the protective member being located generally opposite the second groove such that the protective member is deployed most distantly from the mounting surface of the frame when the leg mount of the rotatable block is perpendicular to the mounting surface of the frame.

16. The table system of claim 15, wherein the protective member on the rotatable block extends past the frame when the second groove is engaged.

17. The table system of claim 12, further comprising a protective member secured upon the rotatable block, the protective member being deployed most distantly from the mounting surface of the frame when the leg mount of the rotatable block is perpendicular to the mounting surface of the frame.

18. The table system of claim 12, wherein the pawl is between the table mounting surface and the rotation axis.

19. The table system of claim 12, wherein the release lever is moved away from the table mounting surface and the support surface of the planar table member to release the pawl from the groove.

20. The table of claim 12, wherein the leg mount includes a table leg projecting therefrom.

21. The table of claim 20, wherein the table leg includes a main support tube, the main support tube connected to the rotatable block at a first end and a horizontal support tube connected to the main support tube at a second end of the main support tube.

22. The table of claim 20, wherein the table leg is one of a plurality of table legs, each of the table legs of the plurality foldable between a position substantially parallel to the table member and a position perpendicular to the table member.

23. The table of claim 22, wherein, the plurality of folding legs includes of a pair of folding legs, fastened and arranged in mirror image fashion and spaced apart, such that the legs, when folded, are co-planar with each other.

* * * * *